US006065304A

United States Patent [19]

Koo

[11] Patent Number: 6,065,304

[45] Date of Patent: May 23, 2000

[54] DEVICE AND METHOD FOR VACUUMIZING AN AIR CONDITIONER HAVING A PLURALITY OF COMPRESSORS AND CONDENSERS

[75] Inventor: Hyoung Mo Koo, Suwon, Rep. of Korea

[73] Assignee: SamSung Electronics Co., Ltd., Kyungki-do, Rep. of Korea

[21] Appl. No.: 09/219,505

[22] Filed: Dec. 23, 1998

[30] Foreign Application Priority Data

Apr. 30, 1998 [KR] Rep. of Korea ..... 98-15668

[51] Int. Cl.[7] ..... F25B 43/04

[52] U.S. Cl. ..... 62/475; 62/292; 62/77

[58] Field of Search ..... 62/292, 77, 475

[56] References Cited

U.S. PATENT DOCUMENTS

| | | | |
|---|---|---|---|
| 5,322,092 | 6/1994 | Howeth et al. | 141/3 |
| 5,339,642 | 8/1994 | Laukhuf | 62/77 |
| 5,359,859 | 11/1994 | Bench et al. | 62/85 |
| 5,533,345 | 7/1996 | Roth | 62/77 |
| 5,537,836 | 7/1996 | Ricketts | 62/149 |
| 5,586,443 | 12/1996 | Lewis | 62/115 |
| 5,709,091 | 1/1998 | Todack | 62/85 |
| 5,943,867 | 8/1999 | Thomas et al. | 62/85 |

*Primary Examiner*—Mark Shulman
*Attorney, Agent, or Firm*—Robert E. Bushnell, Esq.

[57] ABSTRACT

Disclosed are a device and a method for vacuumizing an air conditioner having multiple compressors and multiple condensers respectively connected with the compressors by multiple refrigerant pipes. The refrigerant pipes are interconnected by a connection pipe. An inlet of one of the compressors and the connection pipe are connected to a manifold. A vacuum pump is connected to the manifold. The inlets of compressors other than the compressor connected to the manifold and an outlet of the condensers are closed. Thus, the compressors and the condensers form a closed circuit. When the vacuum pump operates, the inner space of the closed circuit is vacuumized. Since many compressors and condensers can be vacuumized using a single vacuum pump, the cost of manufacturing a vacuumizing device is reduced.

5 Claims, 4 Drawing Sheets

DEVICE AND METHOD FOR VACUUMIZING AN AIR CONDITIONER HAVING A PLURALITY OF COMPRESSORS AND CONDENSERS

BACKGROUND OF THE INVENTION

1. Field of the Invention

The present invention relates to a device and a method for vacuumizing an air conditioner, and more particularly, to a device and a method for vacuumizing the air conditioner having a plurality of compressors and a plurality of condensers respectively corresponding to the compressors, by use of a single vacuum pump.

2. Prior Art

In general, an air conditioner has an indoor unit installed in a room, and an outdoor unit installed outside the room. The outdoor unit has a compressor for compressing refrigerant and a condenser for condensing the refrigerant compressed by the compressor, and the indoor unit has an evaporator for generating cool air by evaporating the refrigerant condensed by the condenser.

The compressor, the condenser and the evaporator are connected serially by refrigerant pipes so as to form a closed circuit. Therefore, the refrigerant returns to the compressor after circulating the compressor, the condenser and the evaporator in order. The refrigerant is filled up in the refrigerant pipes by a separate device for feeding the refrigerant, and in order to fill up the refrigerant sufficiently and enhance the operational efficiency of the cooling system, the inner space of the closed circuit has to be vacuumized previously. Therefore, in the process of manufacturing the air conditioner, the inner space of the closed circuit is vacuumized by a vacuum pump, and then the refrigerant is filled up into the closed circuit.

Recently, a so-called multiple type air conditioner system has been proposed, which has a plurality of compressors and a plurality of condensers. The multiple type air conditioner system enhances the efficiency of cooling by supplying a proper amount of efrigerant into respective evaporators. Such a multiple type air conditioner system has a plurality of cooling systems, each of which forms a closed circuit, so a plurality of vacuum pumps are used in order to vacuumize the respective cooling systems.

FIG. 3 show an outdoor unit of a multiple type air conditioner system employing a conventional vacuumizing device, which particularly shows an outdoor unit 101 having a pair of compressors 103*a* and 103*b* and a pair of condensers 107*a* and 107*b*.

Refrigerant suction pipes 109*a* and 109*b* respectively connected to evaporators (not shown) in an indoor unit are connected to the inlets of the respective compressors 103*a* and 103*b*, and refrigerant discharge pipes 105*a* and 105*b* connected to the inlets of the condensers 107*a* and 107*b* are connected to the outlets of the respective compressors 103*a* and 103*b*. The condensers 107*a* and 107*b* and the evaporators are connected with each other by refrigerant supply pipes 111*a* and 111*b*.

The device for vacuumizing such an air conditioner is comprised of a pair of vacuum pumps 119*a* and 119*b*, and a pair of manifolds 117*a* and 117*b*. The inlets of he manifolds 117*a* and 117*b* are connected with the refrigerant suction pipes 109*a* and 109*b* and the refrigerant supply pipes 111*a* and 111*b*. Thus, the manifolds 117*a* and 117*b*, the compressors 103*a* and 103*b*, and the condensers 107*a* and 107*b* form two closed circuits. The vacuum pumps 119*a* and 119*b* are connected to the manifolds 117*a* and 117*b*, respectively.

In order to vacuumize the outdoor unit 101, the valves (not shown) installed on the inlets of the manifolds 117*a* and 117*b* connected to the respective closed circuits are opened, and then the vacuum pumps 119*a* and 119*b* are operated to draw the air from the manifolds 117*a* and 117*b*.

According to such a conventional vacuumizing device, as shown in FIG. 4, two vacuum pumps 119*a* and 119*b* have to be connected to each of the outdoor units 101. If the outdoor unit 101 has many compressors and many condensers, a number of vacuum pumps and manifolds corresponding thereto have to be equipped in order to vacuumize the respective outdoor unit 101. Therefore, the cost of manufacturing vacuumizing device increases.

SUMMARY OF THE INVENTION

The present invention has been proposed to overcome the above-described problems in the prior art, and accordingly it is the object of the present invention to provide a device and a method for vacuumizing an air conditioner having a plurality of cooling systems using a single vacuum pump.

To achieve the above object, the present invention provides a vacuumizing device for an air conditioner having a plurality of compressors and a plurality of condensers respectively connected with the compressors by a plurality of refrigerant pipes, the vacuumizing device comprising: a connection pipe for interconnecting the refrigerant pipes; a manifold connected to an inlet of one of the compressors and the connection pipe; a means for closing inlets of compressors other than the compressor connected to the manifold and an outlet of the condensers; and a vacuum pump connected to the manifold, the vacuum pump for drawing air from the manifold.

Preferably, a valve is installed on the connection pipe. The valve is opened while the vacuum pump is operating.

According to the present invention, a method for vacuumizing an air conditioner having a plurality of compressors and a plurality of condensers respectively connected with the compressors by a plurality of refrigerant pipes is provided, which comprises the steps of: interconnecting the refrigerant pipes using a connection pipe; connecting an inlet of one of the compressors and the connection pipe to a manifold; closing inlets of compressors other than the compressor connected to the manifold and an outlet of the condensers so as to form a closed circuit; and vacuumizing the inner space of the closed circuit by drawing air from the manifold using a vacuum pump.

Preferably, a valve is installed on the connection pipe, and the valve is opened before the vacuumizing step.

According to the present invention, a single vacuum pump is correspondent to one outdoor unit. Therefore, the cost of manufacturing a vacuumizing device is reduced.

BRIEF DESCRIPTION OF THE DRAWINGS

The present invention will be better understood and its various objects and advantages will be more fully appreciated from the following description taken in conjunction with the accompanying drawings, in which.

DETAILED DESCRIPTION OF THE PREFERRED EMBODIMENT

Hereinafter, the present invention will be described in detail with reference to the accompanying drawings.

Figure 1:
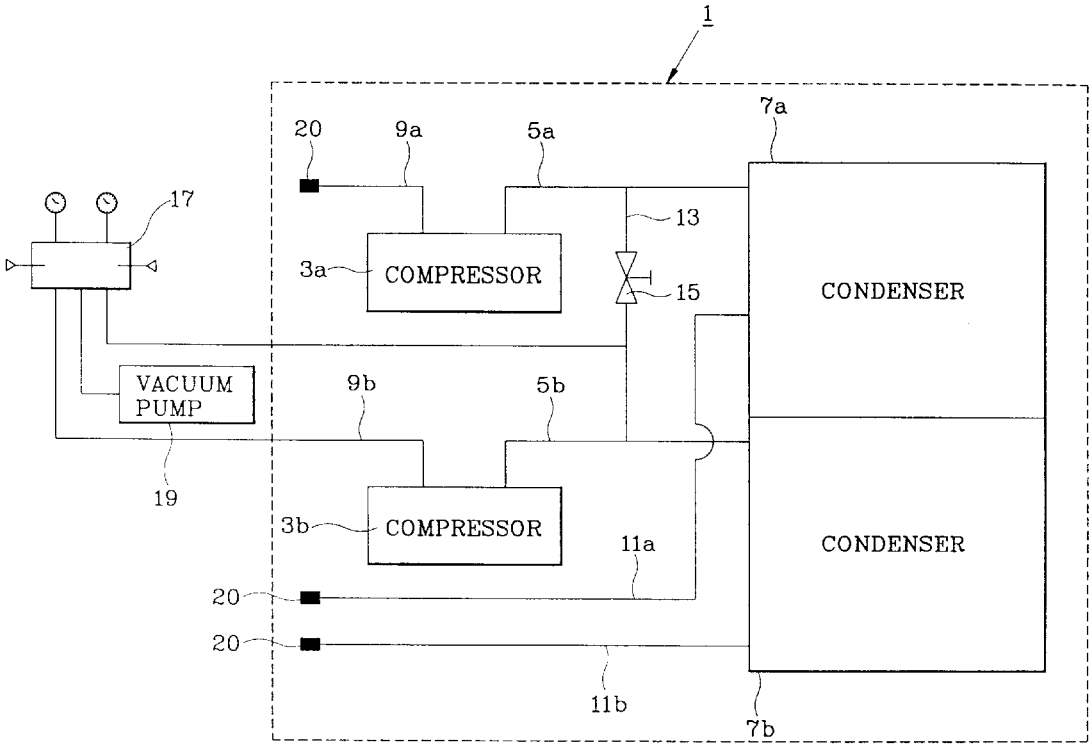
FIG. 1 is a schematic view of an air conditioner employing a vacuumizing device according to the present invention.

FIG. 1 is a schematic view of an air conditioner employing a vacuumizing device according to the present invention, which particularly shows an outdoor unit 1 having a pair of compressors 3*a* and 3*b* and a pair of condensers 7*a* and 7*b*.

Figure 3:
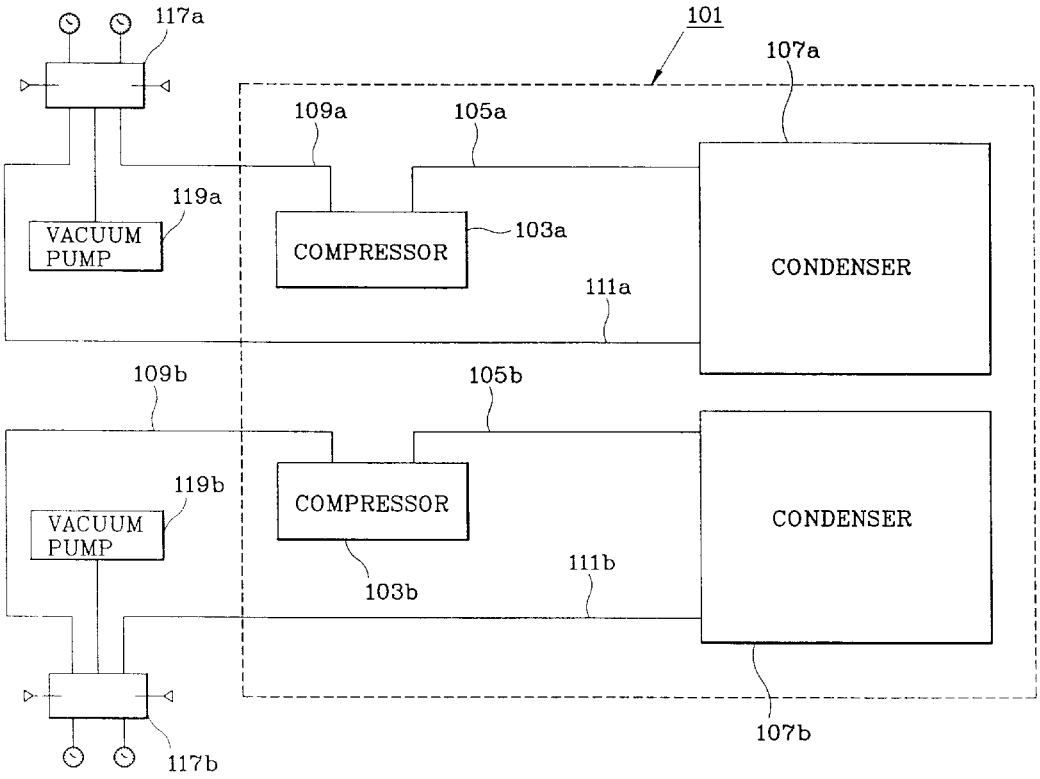
FIG. 3 (PRIOR ART)
FIG. 3 is a schematic view of an air conditioner employing a conventional vacuumizing device.
Figure 4:
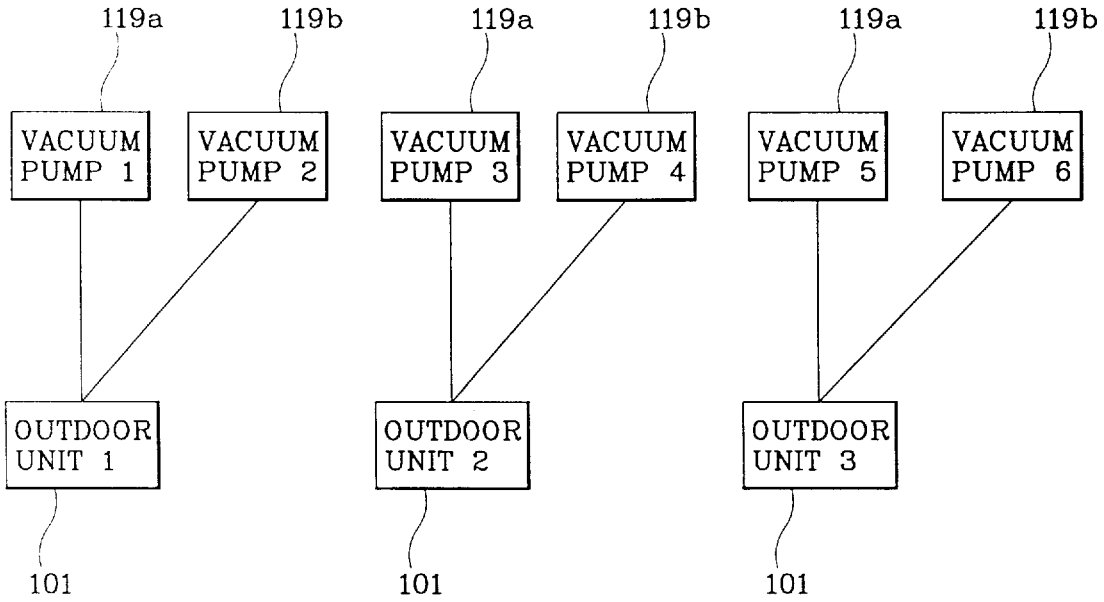
FIG. 4 (PRIOR ART)
FIG. 4 is a schematic view showing the state that a plurality of vacuum pumps are installed on each of the outdoor units, according to the vacuumizing device shown in FIG. 3.

Like the conventional air conditioner which has been illustrated with reference to FIG. 3, refrigerant suction pipes 9*a* and 9*b* are connected to the inlets of the respective compressors 3*a* and 3*b,* and refrigerant discharge pipes 5*a* and 5*b* connected to the inlets of the condensers 7*a* and 7*b* are connected to the outlets of the respective compressors 3*a* and 3*b*. Furthermore, refrigerant supply pipes 11*a* and 11*b* are connected to the outlets of the condensers 7*a* and 7*b*.

The refrigerant discharge pipes 5*a* and 5*b* are interconnected by a connection pipe 13, and a valve 15 is installed on the connection pipe 13. The valve 15 opens/closes the connection pipe 13, and preferably a solenoid valve is used as the valve 15.

The connection pipe 13 and one refrigerant suction pipe 9*b* are connected to the inlets of a manifold 17. A vacuum pump 19 is connected to the outlet of the manifold 17. The end of the refrigerant suction pipe 9*a* other than the refrigerant suction pipe 9*b* connected to the manifold 17, and the ends of the refrigerant supply pipes 11*a* and 11*b* are closed by additional closing members 20. Such closing members 20 can be implemented in a variety of manners.

Figure 2:
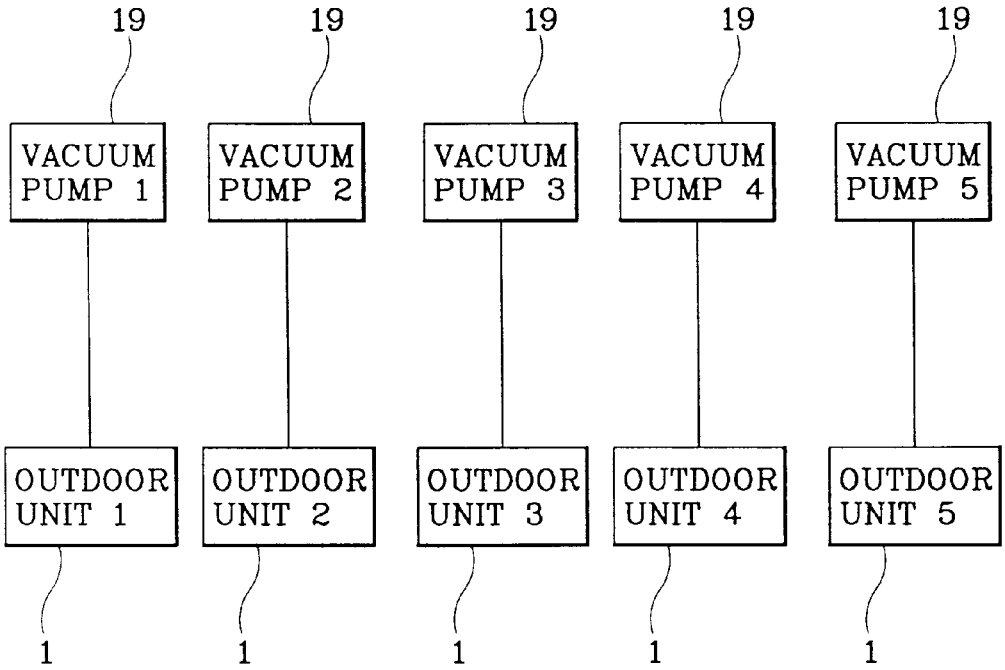
FIG. 2 is a schematic view showing the state that a single vacuum pump is installed on each of the outdoor units, according to the vacuumizing device shown in FIG. 1.

Since the refrigerant discharge pipes 5*a* and 5*b* are interconnected by the connection pipe 13, and the refrigerant pipes 9*a,* 11*a* and 11*b* are closed by the closing members 20, the manifold 17, the compressors 3*a* and 3*b,* and the condensers 7*a* and 7*b* form a closed circuit. Therefore, as shown in FIG. 2, a single vacuum pump 1 corresponds to one outdoor unit 1.

Hereinbelow, the process for installing such a vacuumizing device on the air conditioner and the process for vacuumizing the same will be described.

At first, the refrigerant discharge pipes 5*a* and 5*b* are interconnected using a connection pipe 13 having a valve 15, and the refrigerant suction pipe 9*b* and the connection pipe 13 are connected to the manifold 17. Then, the refrigerant suction pipe 9*b* and the refrigerant supply pipe 11*a* and 11*b* are closed by the closing member 20 so as to form a closed circuit.

In order to vacuumize the outdoor unit 1 forming a closed circuit, a worker opens the valves 15, opens the valves (not shown) installed on the inlets of the manifold 17, and then operates the vacuum pump 19. Then, the air is drawn from the manifold 17, whereby the outdoor unit 1 is vacuumized.

As described above, according to the present invention, a single vacuum pump is correspondent to one outdoor unit 1. Therefore, the cost of manufacturing a vacuumizing device is reduced.

Although the present invention has been described and illustrated in detail, it is clearly understood that the same is by way of illustration and example only and is not to be taken by way of limitation, wherein the spirit and scope of the present invention is limited only by the terms of the appended claims.

What is claimed is:

1. A vacuumizing device for an air conditioner having a plurality of compressors and a plurality of condensers respectively connected with the compressors by a plurality of refrigerant pipes, the vacuumizing device comprising:

a connection pipe for interconnecting the refrigerant pipes;

a manifold connected to an inlet of one of the compressors and the connection pipe;

a means for closing inlets of compressors other than the compressor connected to the manifold and an outlet of the condensers; and a vacuum pump connected to the manifold, the vacuum pump for drawing air from the manifold.

2. The vacuumizing device for an air conditioner as claimed in claim 1, further comprising a valve for opening/closing the connection pipe.

3. The vacuumizing device for an air conditioner as claimed in claim 2, wherein the valve is opened while the vacuum pump is operating.

4. A method for vacuumizing an air conditioner having a plurality of compressors and a plurality of condensers respectively connected with the compressors by a plurality of refrigerant pipes, the method comprising the steps of:

interconnecting the refrigerant pipes using a connection pipe;

connecting an inlet of one of the compressors and the connection pipe to a manifold;

closing inlets of compressors other than the compressor connected to the manifold and an outlet of the condensers so as to form a closed circuit; and vacuumizing the inner space of the closed circuit by drawing air from the manifold using a vacuum pump.

5. The method for vacuumizing an air conditioner as claimed in claim 4, further comprising the steps of:

providing a valve for opening/closing the connection pipe; and opening the valve before the vacuumizing step.

* * * * *